US007291039B2

(12) United States Patent
Shin

(10) Patent No.: US 7,291,039 B2
(45) Date of Patent: Nov. 6, 2007

(54) FLAT CIRCUIT CONNECTOR WITH IMPROVED HOUSING

(75) Inventor: Hee-Seok Shin, Ahnsan-si (KR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/565,876

(22) PCT Filed: Aug. 25, 2004

(86) PCT No.: PCT/US2004/027552

§ 371 (c)(1),
(2), (4) Date: Jul. 10, 2006

(87) PCT Pub. No.: WO2005/022702

PCT Pub. Date: Mar. 10, 2005

(65) Prior Publication Data

US 2007/0134975 A1 Jun. 14, 2007

(30) Foreign Application Priority Data

Aug. 27, 2003 (KR) ..... 10-2003-0059455

(51) Int. Cl.
*H01R 12/24* (2006.01)

(52) U.S. Cl. ..... 439/495; 439/570

(58) Field of Classification Search ..... 439/260, 439/495, 566, 570

See application file for complete search history.

(56) References Cited

U.S. PATENT DOCUMENTS 6,203,345 B1 * 3/2001 Roque et al. ..... 439/260
6,254,406 B1 * 7/2001 Chiu et al. ..... 439/142

* cited by examiner

*Primary Examiner*—Thanh-Tam Le
(74) *Attorney, Agent, or Firm*—Charles S. Cohen

(57) ABSTRACT

An electrical connector is provided for terminating a flat electrical circuit. The connector includes an elongated dielectric housing having an opening for receiving an end of the flat circuit. A plurality of terminals are mounted on the housing in a side-by-side array and spaced along the opening. An elongated actuator is pivotally mounted on the housing for rotating movement between an open position allowing the flat circuit to be inserted into the opening and a closed position biasing the flat circuit against the terminals. The actuator includes rotating bosses at opposite longitudinal ends thereof and cam projections on end faces of the bosses. The housing includes an elongated rear portion into which the terminals can be mounted from the rear of the connector. A platform portion projects forwardly of the rear portion and combines therewith to define the opening into which the flat circuit can be inserted from the front of the connector onto the top of the platform. A pair of end walls are spaced outwardly from opposite longitudinal ends of the rear portion to define a pair of actuator-receiving slots for receiving the rotating bosses of the actuator. Cam grooves are formed in the inside faces of the end walls for receiving the cam projections on the actuator.

1 Claim, 5 Drawing Sheets

FLAT CIRCUIT CONNECTOR WITH IMPROVED HOUSING

FIELD OF THE INVENTION

This invention generally relates to the art of electrical connectors and, particularly, to a connector for terminating a flat circuit, such as a flat flexible circuit, a flexible printed circuit or other flat electrical cable.

BACKGROUND OF THE INVENTION

A wide variety of electrical connectors have been designed for terminating flat cables or circuits. A typical connector for flat circuits includes a dielectric housing molded of plastic material, for instance. The housing has an elongated opening or slot for receiving an end of the flat circuit which has generally parallel, laterally spaced conductors exposed across the end. A plurality of terminals are mounted in the housing and are spaced laterally along the slot, with contact portions of the terminals engageable with the laterally spaced conductors of the flat circuit. An actuator often is movably mounted on the housing for movement between a first position whereat the flat circuit is freely insertable into the slot and a second position whereat the actuator clamps the circuit in the housing and biases the circuit against the contact portions of the terminals.

FIGS. 7 and 8 herein show a prior art flat circuit connector of the character described above. The connector includes a housing, generally designated 20, having a plurality of terminals, generally designated 22, mounted in the housing from the rear thereof. The housing is mounted on a printed circuit board (not shown) and is fabricated of dielectric plastic material. The housing has a slot 20*a* at the front thereof for receiving an end of a flat circuit in a circuit insertion direction as indicated by arrow "B". The housing includes a rear portion 24*b* having a plurality of pairs of terminal-receiving passages 20*c* into which terminals 22 are mounted. Finally, the housing is elongated and includes a pair of walls or fixing arms 20*d* having fixing grooves 20*e* formed on the insides thereof. An elongated actuator, generally designated 24, is pivotally mounted on housing 20 by means of a pair of fixing protrusions 24*a* having pivot bosses 24*b* at opposite ends of the housing. The fixing protrusions are rotatably mounted in fixing grooves 20*e* formed inside arms 20*d*. A pair of locking protrusions 24*c* are formed at opposite ends of the elongated actuator at the front thereof. The locking protrusions are hooked against the front of the housing when the actuator is in a closed position as shown in FIG. 7.

A pair of substantially enclosed fitting nails 26 are mounted over generally inverted T-shaped mounting portions 20*f* of the housing in the direction of arrows "B". The fitting nails are fabricated of metal material and are soldered to mounting pads on the printed circuit board to secure the connector to the board.

Actuator 24 is rotated 90° from its closed position shown in FIG. 7, to stand upright, and its rear end is inserted between fixing arms 20*d* of the housing. Fixing protrusions 24*a* are respectfully inserted into fixing grooves 20*e* inside arms 20*d* to fixed the actuator to the housing. This defines the open position of the actuator. While the actuator is in this open position, the end of the flat circuit is inserted into slot 20*a* in the direction of arrow "A". The actuator then is rotated about pivot bosses 24*b* to the closed position shown in FIG. 7 to bias appropriate contacts on the bottom of the flat circuit against terminals 22.

The present invention is directed to improvements in a housing for flat circuit connectors as described above.

SUMMARY OF THE INVENTION

An object, therefore, of the invention is to provide a new and improved electrical connector for terminating a flat electrical circuit.

In the exemplary embodiment of the invention, the connector includes an elongated dielectric housing having an opening for receiving an end of the flat circuit. A plurality of terminals are mounted on the housing in a side-by-side array and spaced along the opening. An elongated actuator is pivotally mounted on the housing for rotating movement between an open position allowing the flat circuit to be inserted into the opening and a closed position biasing the flat circuit against the terminals. The actuator includes rotating bosses at opposite longitudinal ends thereof and cam projections on end faces of the bosses. The housing includes an elongated rear portion into which the terminals can be mounted from the rear of the connector. A platform portion projects forwardly of the rear portion and combines therewith to define the opening into which the flat circuit can be inserted from the front of the connector onto the top of the platform. A pair of end walls are spaced outwardly from opposite longitudinal ends of the rear portion to define a pair of actuator-receiving slots for receiving the rotating bosses of the actuator. Cam grooves are formed in the inside faces of the end walls for receiving the cam projections on the actuator.

According to one aspect of the invention, the terminals have contact arms with contact portions projecting into the opening for engaging appropriate contacts on the flat circuit. The housing includes a plurality of guide grooves on top of the platform portion for receiving the contact arms of the terminals. The housing has a plurality of partitions between the guide grooves. The partitions have sloped front end surfaces for guiding the flat circuit into the housing.

According to a further aspect of the invention, a pair of fitting nails are provided for fixing the connector to a printed circuit board. The end walls of the housing include nail-receiving passages opening at a front of the housing for inserting the fitting nails into the passages. The passages are in communication with the actuator-receiving slots, and the fitting nails include actuator supporting portions extending into the slots.

According to a further aspect of the invention, the actuator includes longitudinally outwardly projecting locking protrusions at opposite ends thereof. The end walls of the housing include locking grooves on the insides thereof for receiving the locking protrusions when the actuator is in its closed position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
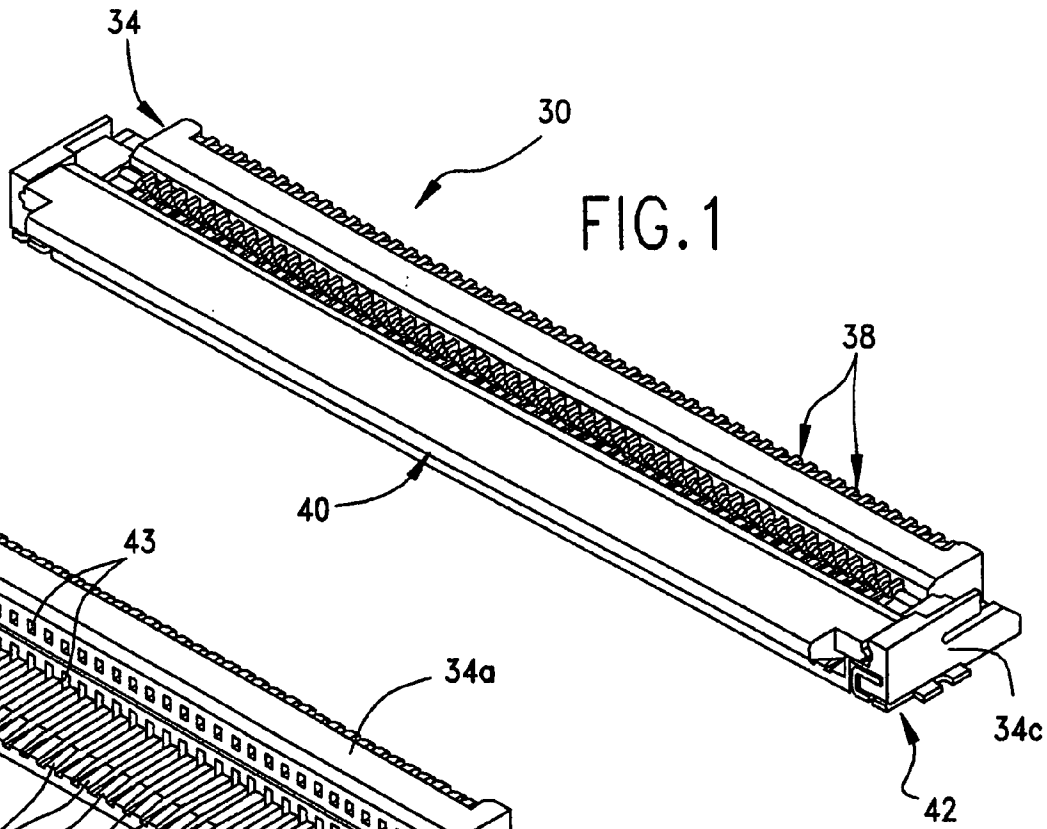
FIG. 1 is a perspective view of a flat circuit connector according to the invention, with the actuator in its closed position.
Figure 2:
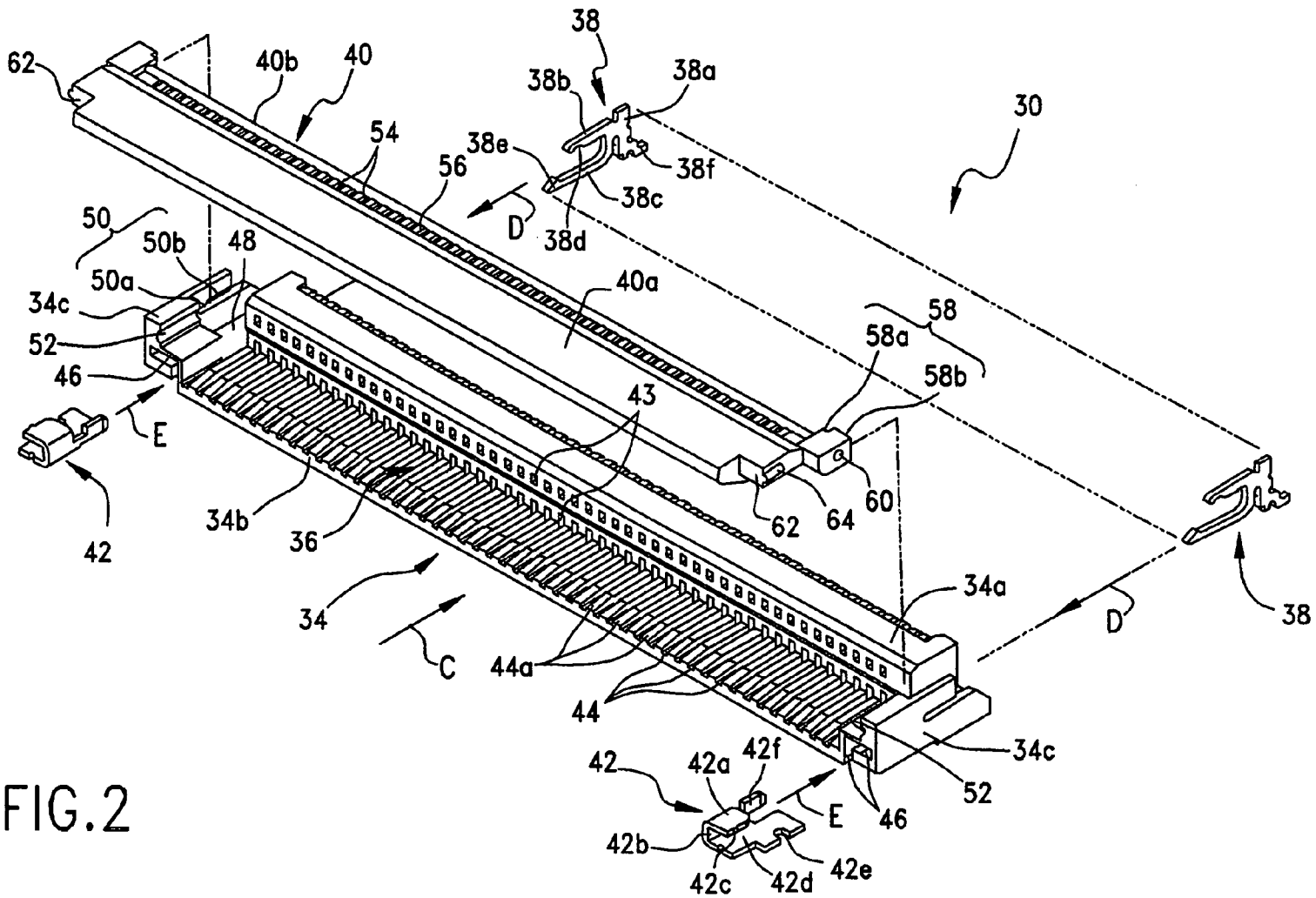
FIG. 2 is an exploded perspective view of the connector.

Referring to the drawings in greater detail, and first to FIGS. 1 and 2, the invention is embodied in an electrical connector, generally designated 30, for connecting a flat electrical circuit 32 (not shown) to a printed circuit board (not shown). The flat electrical circuit may include flat cables or circuits, flat flexible cables, flexible printed circuits or the like.

Connector 10 includes a dielectric housing, generally designated 34, which is elongated and may be molded of plastic material. The housing defines a slot, generally designated 36, at the front end of the housing for receiving an end of the flat circuit in a circuit insertion direction as indicated by arrow "C" in FIG. 2. A plurality of conductive terminals, generally designated 38, are mounted in housing 34 in a side-by-side array and spaced along slot 36. Only the two end-most terminals are shown in FIG. 2. An actuator, generally designated 40, is pivotally mounted on housing 34 for movement between an open position (FIG. 6) allowing the flat circuit to be inserted into slot 36 and a closed position (FIG. 5) biasing the flat circuit against the terminals, as will be seen hereinafter. The terminals are inserted into the rear of the housing in the direction of arrows "D" and a pair of fitting nails, generally designated 42, are inserted into the front of the housing in the direction of arrows "E".

Figure 5:
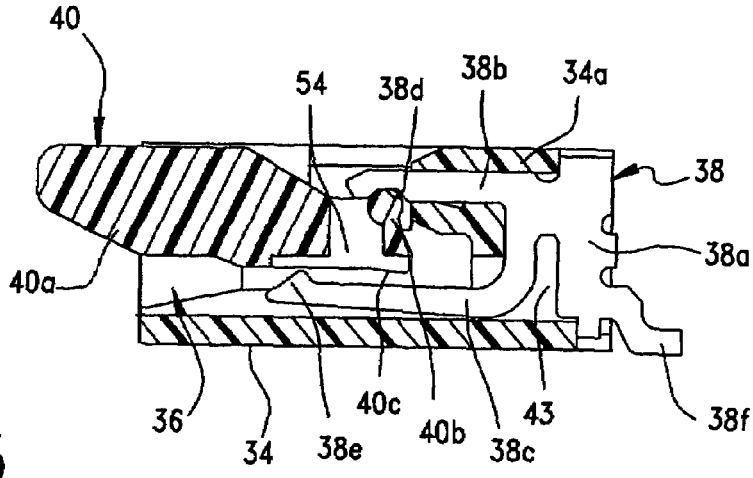
FIG. 5 is an enlarged front-to-rear section through the connector, with the actuator in its closed position.

Referring to FIG. 5 in conjunction with FIG. 2, terminals 38 are inserted into terminal-receiving passages 43 in housing 34. Each terminal includes a generally horizontally oriented, U-shaped configuration defined by a base, 38*a*, an upper pivot arm 38*b* and a lower contact arm 38*c*. The upper pivot arm has a pivot groove 38*d* formed in the underside thereof near the distal end thereof. The contact arm has a contact portion 38*e* at the distal end thereof projecting into the circuit-receiving slot 36. A foot 38*f* projects downwardly from base 38*a* and is disposed generally flush with the bottom of housing 34 for connection to an appropriate circuit trace on the printed circuit board. The terminals are stamped and formed of conductive sheet metal material.

Figure 3:
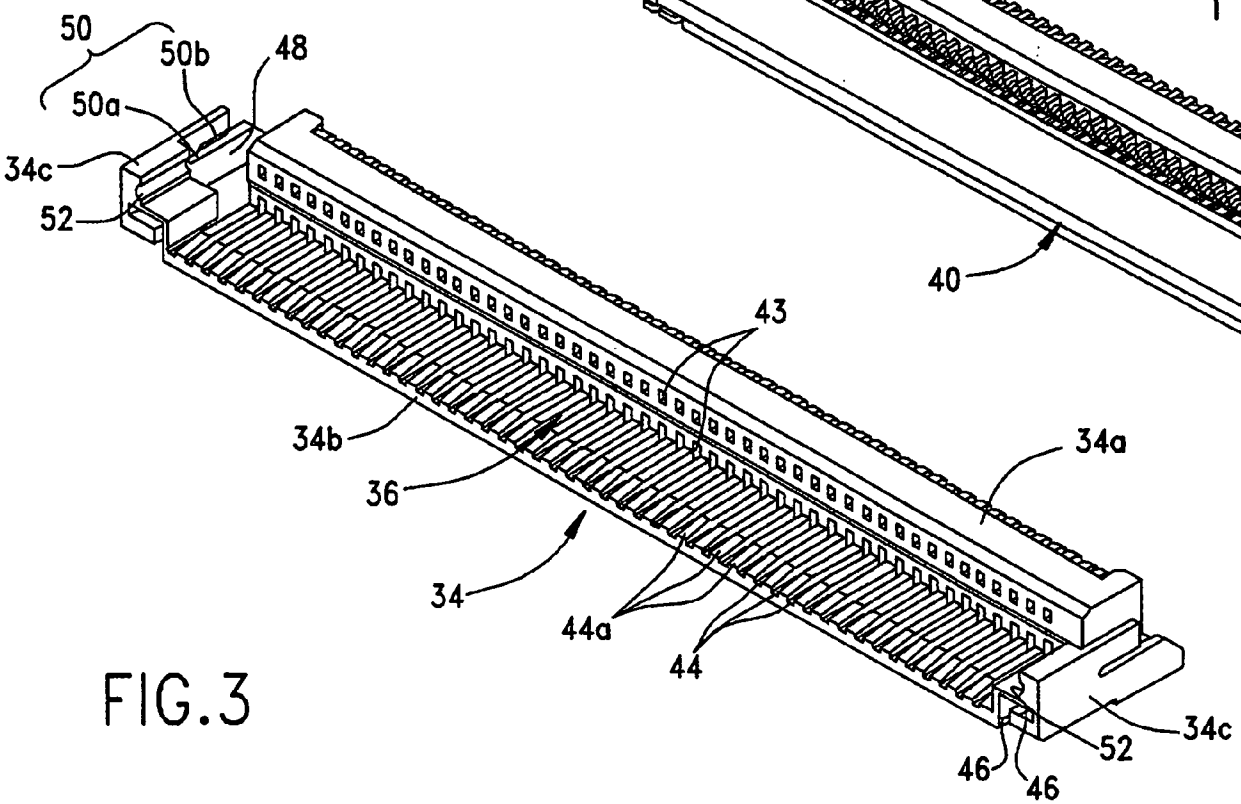
FIG. 3 is a perspective view of the housing of the connector.
Figure 4:
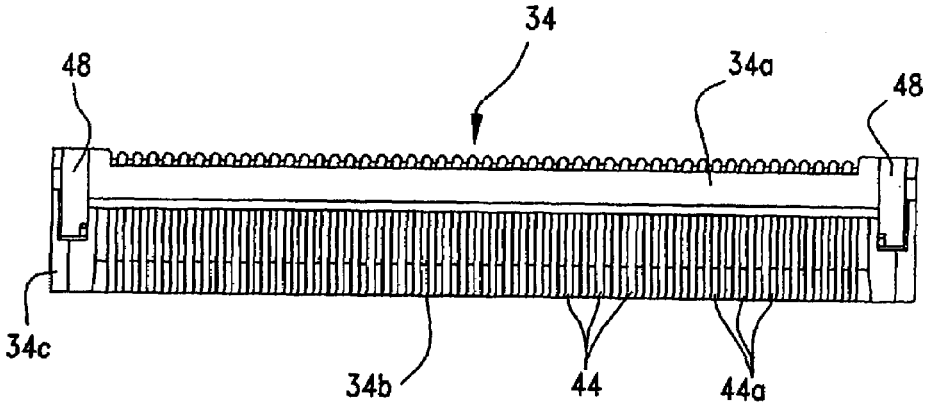
FIG. 4 is a top plan view of the housing.

Referring to FIGS. 3 and 4 in conjunction with FIGS. 1 and 2, housing 34 is elongated and includes an upstanding rear portion 34*a* and a bottom, forwardly projecting platform portion 34*b* whereby the circuit-receiving slot 36 is open in an upward and forward direction. A plurality of generally parallel guide grooves 44 are spaced along platform portion 34*b* between a plurality of partitions 44*a*. When terminals 38 are inserted into the housing, contact arms 38*c* are guided into grooves 44, with the contact portions 38*e* projecting upwardly into the circuit-receiving slot 36. Partitions 44*a* have sloped surfaces on the tops thereof and the ends thereof for guiding the flat circuit into opening 36.

A pair of end walls 34*c* are formed integrally with housing 34. Fitting nails 42 are inserted in the direction of arrows "E" into a pair of inverted L-shaped nail-receiving passages 46 formed in the pair of end walls and opening at the front of the housing. An upwardly opening actuator-receiving slot 48 is formed in each end wall 34*c* at the rear thereof behind and in communication with the respective nail-receiving passage 46. A rotating cam groove or recess 50 is formed inside each end wall 34*c* within slot 48. The cam-receiving groove 50 includes a first cam groove or recess 50*a* and a second cam groove or recess 50*b* above the first groove, for purposes described hereinafter. A locking groove 52 is formed on the inside of each end wall 34*c* above the respective nail-receiving passage 46.

Actuator 40 is elongated and includes an elongated pressure plate 40*a* along the front thereof and an elongated pivot shaft 40*b* along the rear thereof spaced from the pressure plate. The actuator is a one-piece structure, and pivot shaft 40*b* is connected to pressure plate 40*a* by a plurality of supports 54 at spaced intervals along the length of the actuator, and defining spaces 56 between the supports. A rounded pressing portion 40*c* is formed at the bottom rear corner of the actuator.

Actuator 40 further includes a block-like support boss 58 at each opposite end thereof. A rotating cam 60 projects outwardly from the outer surface of boss 58. Boss 58 has a support 58*a* and a movement prevention portion 58*b*, for purposes described hereinafter. Pressure plate 40*a* of actuator 40 includes a cut-out 62 at each corner thereof. Finally, a locking protrusion 64 projects outwardly from each opposite end of pressure plate 40*a*.

Each fitting nail 42 includes an L-shaped mounting portion 42*a* defined by a vertical or upright support plate 42*b* and a horizontal support plate 42*c*. The L-shaped mounting portion is insertable into the respective L-shaped passage 46 at the front of the respective end wall 34*c* of the housing. The fitting nail has a horizontal fixing plate or foot 42*d* at the bottom thereof and which will be generally flush with housing 34 for connection, as by soldering, to a mounting pad on the printed circuit board to fix the connector to the board. An open-sided hole 42*e* is formed in the outer edge of fixing plate 42*d* for receiving a fixing member (not shown) to further fix the connector to the board. According to the invention, each fitting nail 42 includes a biasing portion or elevating arm 42*f* in the form of a vertical plate for biasing actuator 40 upwardly and securely seat pivot shaft 40*b* of the actuator into pivot grooves 38*d* of terminals 38. In essence, plate 42*f* vertically supports the actuator, particularly in its closed position.

Figure 6:
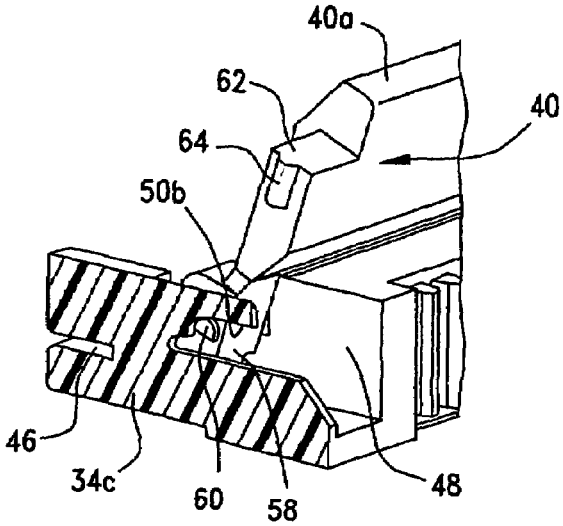
FIG. 6 is a fragmented perspective view, partially in section, of one end of the connector with the actuator in its open position.
Figure 7:
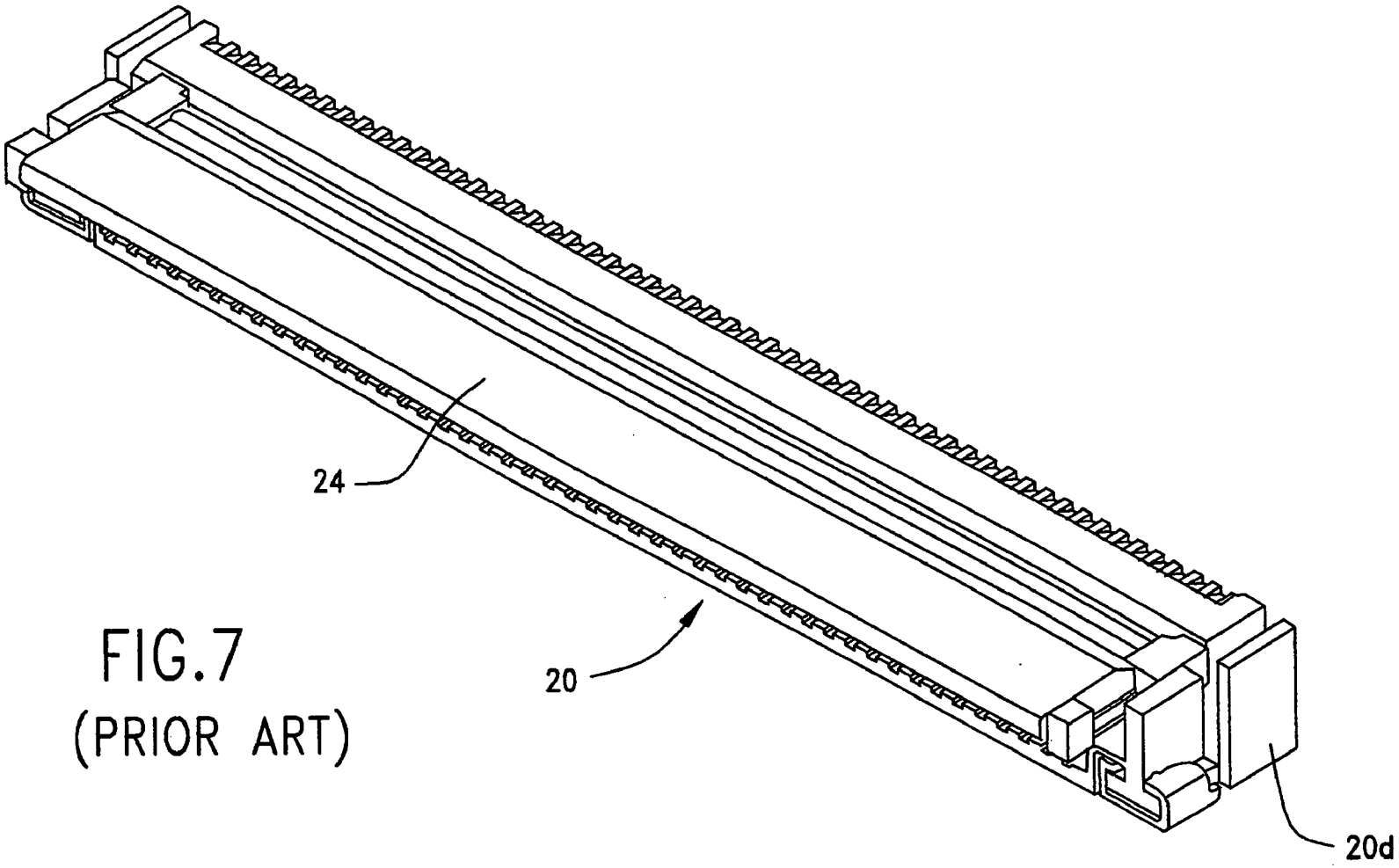
FIG.7 (PRIOR ART)
FIGS. 7 and 8 are views of the prior art connector described in the Background, above.
Figure 8:
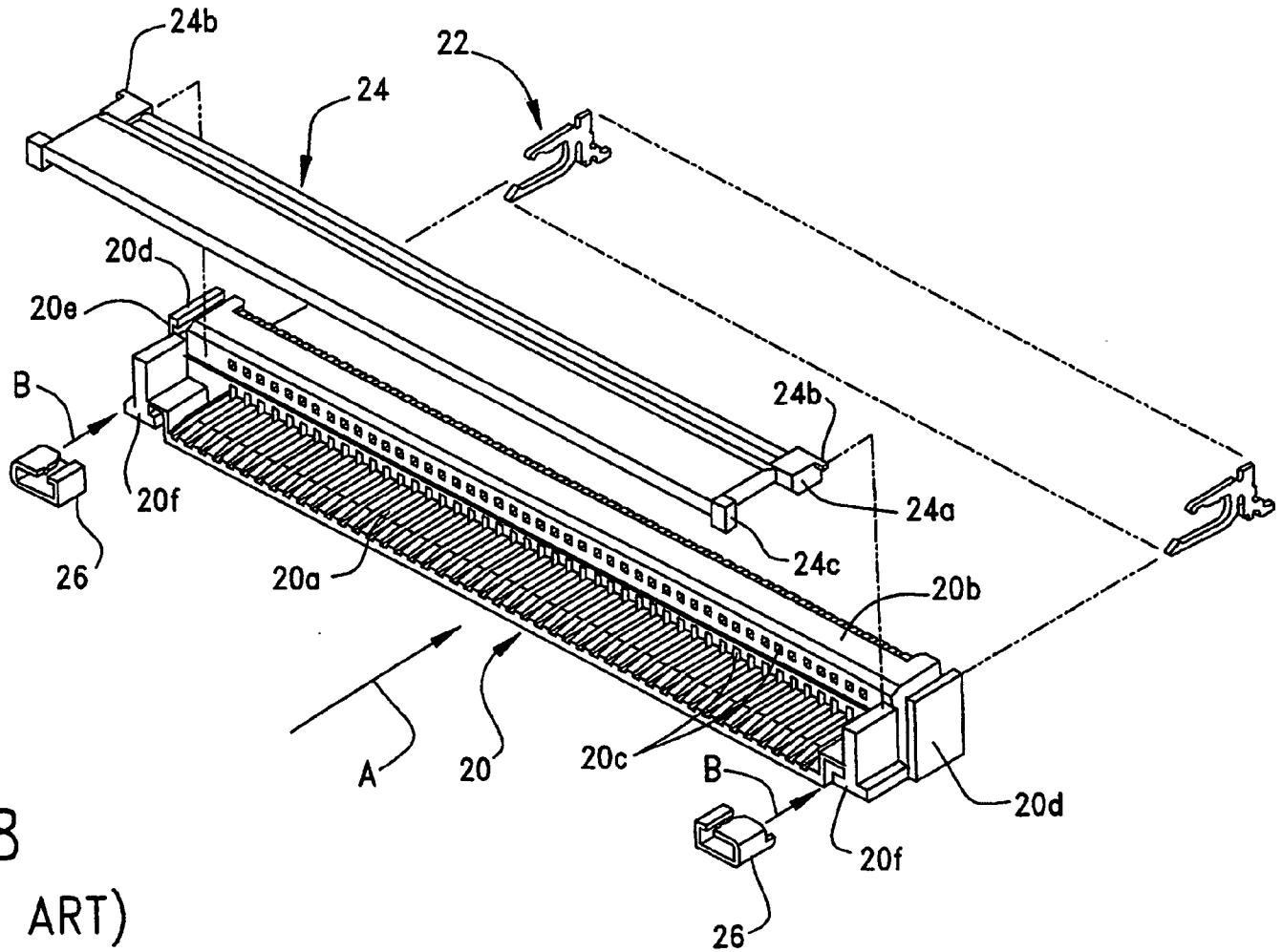
FIG.8 (PRIOR ART)

FIG. 6 shows actuator 40 in an upright or open position so that an end of a flat circuit can be inserted freely into slot 36. It can be seen that support boss 58 of the actuator is positioned within the actuator-receiving slot 48 in end wall 34*c* of the housing. Cam projection 60 is located in cam groove 50*b*. After the flat circuit is inserted into space 36, actuator 40 is pivoted downwardly to its closed position shown in FIG. 5. It can be seen that pivot shaft 40*b* is seated in pivot grooves 38*d* in the underside of pivot arms 38*b* of terminals 38. In this position, pressure plate 40*a* of the actuator will press the flat circuit against contact portions 38*e* of contact arms 38*c* of the terminals. When the actuator is rotated to its closed position, locking projection 64 snaps into locking groove 52 (see FIG. 2) in the inside of end wall 34*c*.

Actuator 40 is assembled to housing 34 by orienting the actuator in an upright position and moving the actuator downwardly. During assembly, cam projections 60 snap into cam grooves 50*a* in the inside surfaces of end walls 34*c*. To that end, the outer surfaces of cam projections 60 are tapered, and the longitudinal distance between the outer extremities of cam projections 60 is slightly larger than the distance between the inside surfaces of end walls 34*c* so that the end walls spread outwardly due to their own elasticity, and the end walls move back inwardly to their normal condition once cam projections 60 "snap" into first cam grooves 50*a*.

Terminals 38 are assembled into passages 43 in housing 34 by first pivoting actuator 40 to its closed position as shown in FIG. 5. The terminals are inserted into the passages in the direction of arrow "D" until the terminals are firmly seated as shown in FIG. 5. Pivot arms 38*b* of the terminals are located in spaces 56 between supports 54 of the actuator. Contact arms 38*c* of the terminals extend into guide grooves 44 between partitions 44*a* on top of platform portion 34*b* of housing 34.

When the fitting nails are fully inserted into the housing, biasing portions or plates 42*f* of the fitting nails form elevating cams which engage the bottom of actuator 40 to bias the actuator upwardly. The effect of this upwardly biasing motion of the actuator moves pivot shaft 40*b* of the actuator into pivot grooves 38*d* of terminals 38 to rigidly secure the actuator in the connector and to allow for positive pivoting of the actuator relative to the housing. In addition, cam projections 60 (FIG. 2) will move from first cam grooves 50*a* to second cam grooves 50*b*.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector (30) for terminating a flat electrical circuit, comprising:

an elongated dielectric housing (34) having an opening (36) for receiving an end of the flat circuit;

a plurality of terminals (38) mounted on the housing in a side-by-side array and spaced along the opening, said terminals having contact arms (38*b*) with contact portions (38*e*) projecting into said opening for engaging appropriate contacts on the flat circuit;

an elongated actuator (40) pivotally mounted on the housing for rotating movement between an open position allowing the flat circuit to be inserted into said opening and a closed position biasing the flat circuit against the terminals, the actuator having rotating bosses (58) at opposite longitudinal ends thereof and cam projections (60) on end faces of the bosses and including longitudinally outwardly projecting locking protrusions (64) at opposite ends thereof;

a pair of fitting nails (42) for fixing the connector to a printed circuit board and said housing (34) including an elongated rear portion (34*a*) into which the terminals can be mounted from the rear of the connector, a platform portion (34*b*) projecting forwardly of the rear portion and combining therewith to define said opening into which the flat circuit can be inserted from the front of the connector onto the top of the platform, a pair of end walls (34*c*) spaced outwardly from opposite longitudinal ends of the rear portion to define a pair of actuator-receiving slots (48) for receiving the rotating bosses of the actuator and including locking grooves (52) on the insides thereof for receiving the locking protrusions (64) when the actuator is in its closed position, cam grooves (50) in the inside faces of the end walls for receiving the cam projections on the actuator, a plurality of guide grooves (44) on top of the platform portion for receiving the contact arms of the terminals with a plurality of partitions (44*a*) between the guide grooves (44), the partitions having sloped front end surfaces for guiding the flat circuit into said opening (36), and said pair of end walls (34*c*) including nail-receiving passages (46) opening at a front of the housing for inserting the fitting nails into the passages, said nail-receiving passages (46) being in communication with said actuator-receiving slots (48), and the fitting nails (42) including actuator supporting portions (42*f*) extending into the slots.

* * * * *